United States Patent [19]

Deutsch et al.

[11] 4,047,260

[45] Sept. 13, 1977

[54] MOP AND DUSTING DEVICE

[76] Inventors: Bennett Deutsch; Maria E. Deutsch, both of Rte. 1, Box 4820, Bonita Springs, Fla. 33923

[21] Appl. No.: 644,728

[22] Filed: Dec. 29, 1975

[51] Int. Cl.[2] ..... A47L 13/24

[52] U.S. Cl. ..... 15/147 A

[58] Field of Search ..... 15/143 A, 144 B, 147 R, 15/147 A, 147 B, 147 C, 220 R, 228, 229; 403/191

[56] References Cited

U.S. PATENT DOCUMENTS

| | | | |
|---|---|---|---|
| 592,018 | 10/1897 | Olds | 403/191 |
| 861,867 | 7/1907 | Lefevre | 15/228 |
| 2,038,379 | 4/1936 | Ostdiek | 15/147 A |
| 2,537,784 | 1/1951 | Nord | 15/147 R X |
| 2,587,913 | 3/1952 | Smith | 15/147 A |

FOREIGN PATENT DOCUMENTS

| | | | |
|---|---|---|---|
| 498,406 | 1/1951 | Belgium | 15/247 |
| 112,357 | 10/1964 | Czechoslovakia | 403/191 |
| 530,195 | 9/1921 | France | 15/229 AP |
| 252,081 | 5/1881 | Switzerland | 56/400.21 |
| 290,106 | 5/1928 | United Kingdom | 403/191 |
| 226,927 | 1/1925 | United Kingdom | 403/191 |

*Primary Examiner*—Daniel Blum

[57] ABSTRACT

A simple, lightweight T-shaped mop head and handle device accomplishes a variety of dry or wet mopping as well as dusting jobs. The structure is preferrably fabricated from two lengths of lightweight aluminum tubing attached in a T-configuration by an aluminum, generally U-shaped bracket and two rivets. Lengths of any of a variety of fabric or synthentic materials may be wrapped around the cross head of the device. An upwardly projecting stud may be provided adjacent each end of the cross head of the device to hold the material wrapped therearound in place.

2 Claims, 5 Drawing Figures

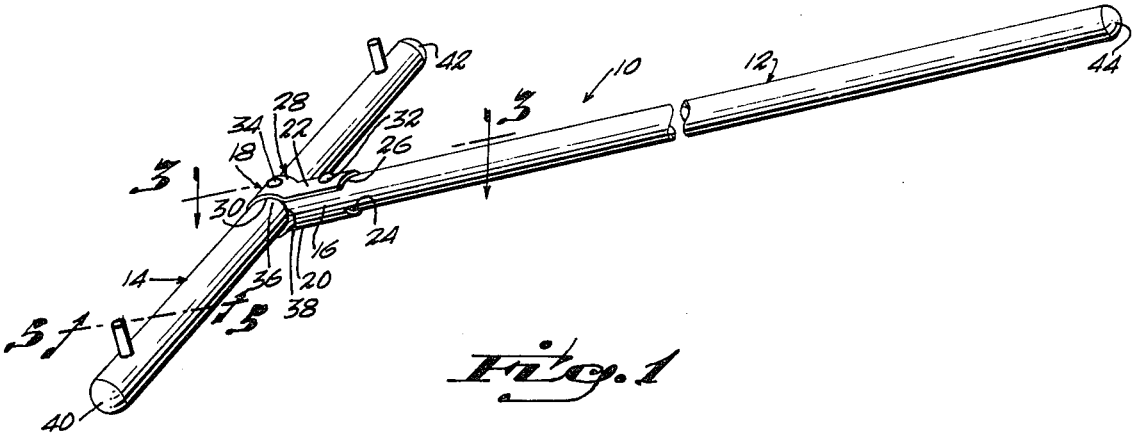
Fig. 1
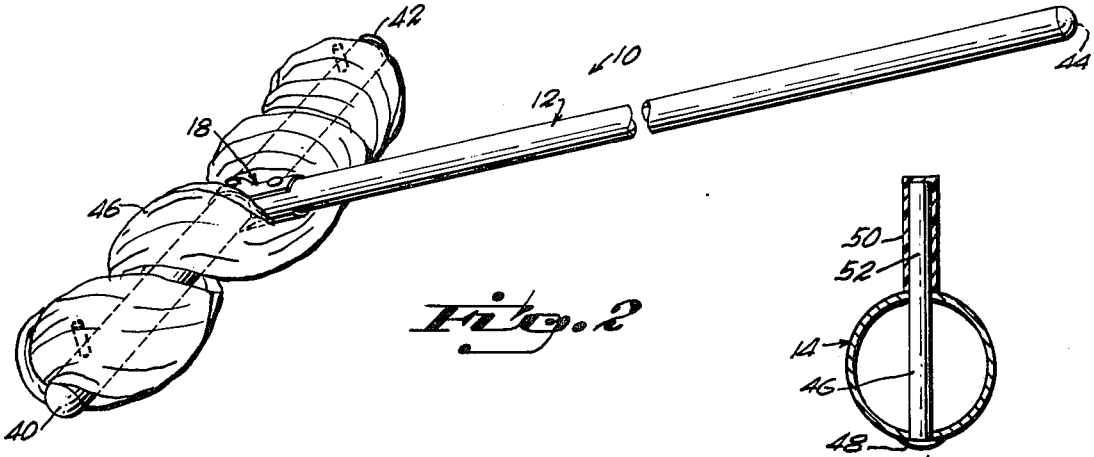
Fig. 2
Fig. 5
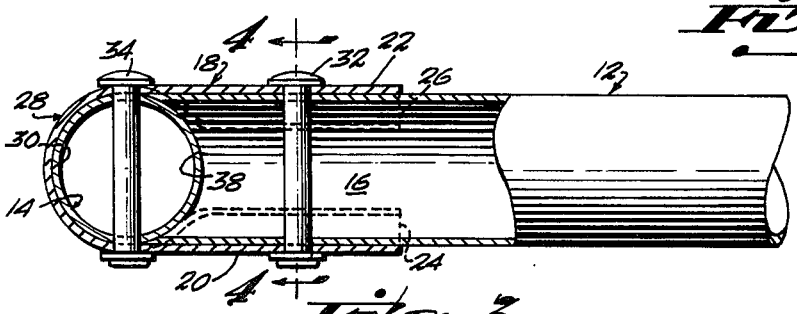
Fig. 3
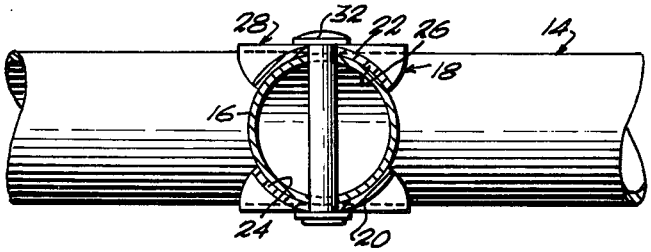
Fig. 4

MOP AND DUSTING DEVICE

OBJECTS AND ADVANTAGES OF THE PRESENT INVENTION

One of the principal objects of the present invention is to provide a simple light weight T-shaped device comprising a cross head member to receive an appropriate length of material in a wrapped around condition and an elongated handle to accomplish a variety of dry or wet mopping as well as dusting jobs.

Another principal object of this invention is to provide such a device which is fabricated of three basic members and is held in assembly by two rivets, the handle, cross head and an attaching bracket perferably being formed of a light weight material such as aluminum.

A further object of the instant invention is to close the opposed open ends of the cross head and the extended open end of the handle as by spinning the ends to a rounded, closed condition.

Yet another object of this invention is to provide a mop and dusting device which is very simple, strong and inexpensive to construct, is adaptable to a wide variety of uses, is very light in weight and which requires a minimum of storage space.

Another object of this invention is to provide upwardly projecting studs adjacent each end of the cross head to maintain the mopping material in place.

BRIEF DESCRIPTION OF THE DRAWINGS

FIG. 1 is a perspective view of the T-shaped mop and dusting device of the present invention;

FIG. 2 is a perspective view similar to FIG. 1 and illustrating a length of material wrapped around the cross head thereof;

FIG. 3 is a longitudical sectional view taken along the line 3—3 of FIG. 1;

FIG. 4 is a cross sectional view taken along line 4—4 of FIG. 3; and FIG. 5 is a cross sectional view taken along line 5—5 of FIG. 1.

DETAILED DESCRIPTION OF THE DRAWINGS

With reference to the drawings in which like reference numerals designate like or corresponding parts throughout the various views and with particular reference to FIG. 1, the mop and dusting device of the present invention is indicated generally at 10 and includes an elongated tubular handle member 12 and a tubular cross head 14, fixed relative to one end thereof.

As best illustrated in FIGS. 1, 3 and 4, the inner end 16 of handle 12 is fixed centrally of the cross head 14 by means of a generally U-shaped bracket 18. The two leg portions 20 and 22 of the bracket 18 are transversely, inwardly curved at 24 and 26 to conform with and engage snugly against the outer contour of the circumference of the inner handle end 16. The base 28 of U-bracket 18 is curved at 30 to snugly engage about the outer contour of the circumference of the central portion of the cross head 14.

A first rivet 32 is fixed through the bracket leg portions 20, 22 and the inner handle end 16, and a second rivet 34 is fixed through the central portion 36 of the cross head 14 and the juncture of the bracket legs 20, 22 and the bracket base portion 28. As best seen in FIGS. 1 and 3 the inner end 16 of handle member 12 terminates in an arcuate configuration 38 conforming with the contour of the outside circumference of the cross head 14. Because of the configuration of the bracket 18, the rivet connections 32 and 34 and the end arcuate handle configuration 38 as above described, the connection between the handle member 12 and the cross head 14 is extremely strong and rigid.

The opposed outer ends of the cross head tube 14 and the extended end of the handle member 12 are provided with rounded closures at 40, 42 and 44.

As illustrated in FIG. 5, a stud 46 may be extended upwardly through appropriate holes in cross head 14 adjacent each end thereof. Each stud 46 is provided with a lower head 48 and a sleeve cap 50 of a synthetic material such as nylon, is press fitted over the upward extended end portion 52 thereof to maintain the stud 46 in place.

In use, a length of an appropriate material 46 is wound about the cross head 14 as illustrated in FIG. 2. The type of material may vary considerably. For example, various types of fabrics both natural and synthetic may be used. Sponge type of synthetic materials may be would around the cross head and held thereon by means of a rubber band engaged around each end portion. Because of the extremely light weight of the device, it is readily adaptable to overhead dusting or mopping jobs relative to walls, ceilings or the like and for simply removing cobwebs, for exaple, therefrom. Whether the device is used for dry or wet mopping relative to floors, walls, ceilings, etc., or for various dusting jobs, the material used may be readily unwound from the cross head for cleaning purposes.

What is claimed is:

1. A combination mop and dusting fabric holder comprising an elongated tubular handle member, and an elongated, substantially cylindrical tubular cross head member fixed at right angles relative to said handle member by a generally U-shaped bracket means defining a generally T-shaped assembly, said U-shaped bracket means comprising a pair of leg portions fixed to opposite sides of a first end portion of said tubular handle and a base portion fixed to the mid-portion of said cross head, said bracket leg portions being curved transversely, inwardly to conform with and engage against the contour of the outer circumference of said handle first end portion, said bracket base portion being curved to conform with and engage against the contour of the outer circumference of said cross head, said handle first end portion terminating in an arcuate configuration bearing against and conforming with the contour of the outside diameter of said cross head, a single rivet rigidly fixing said bracket leg portions and said handle first end portion, a single rivet passing through the central portion of said cross head and said bracket at the juncture of said leg portions and said bracket base for rigidly coupling the same, a stud extending generally upwardly through each end portion of said cross head adjacent opposite ends of the cross head, each stud providing a headed lower end and an upwardly projecting portion, and an elongated cap of a synthetic material press fitted over each said upwardly projecting portion and engaging the cross head to fix the stud.

2. A combination mop and dusting device as defined in claim 1 wherein the opposed ends of said tubular cross head member and the extended end of said tubular handle member are closed in rounded configurations.

* * * * *